US005908102A

United States Patent [19]

Plesh, Sr.

[11] Patent Number: 5,908,102

[45] Date of Patent: Jun. 1, 1999

[54] HIGH CAPACITY AND EASY TO MAINTAIN INSERT FOR COOLING BED PLATE TRANSFER GRID

[76] Inventor: Ronald L. Plesh, Sr., 31 Hemlock Hill, Orchard Park, N.Y. 14127

[21] Appl. No.: 08/768,712

[22] Filed: Dec. 18, 1996

[51] Int. Cl.[6] ..... B65G 13/00

[52] U.S. Cl. ..... 193/35 R

[58] Field of Search ..... 198/615, 721; 193/35 R, 37; 72/251

[56] References Cited

U.S. PATENT DOCUMENTS

| | | | |
|---|---|---|---|
| 1,842,396 | 1/1932 | Fitch | 193/35 R |
| 2,593,089 | 4/1952 | Barry | 193/37 |
| 3,509,978 | 5/1970 | Bedford | 193/35 R |
| 3,514,001 | 5/1970 | De Meritt et al. | 193/35 R |
| 3,645,379 | 2/1972 | Kornylak | 193/37 |
| 5,265,711 | 11/1993 | Plesh, Sr. . | |
| 5,301,785 | 4/1994 | Plesh, Sr. . | |
| 5,472,179 | 12/1995 | Wendt et al. . | |

*Primary Examiner*—Joseph E. Valenza
*Attorney, Agent, or Firm*—James C. Simmons

[57] ABSTRACT

A high capacity and easy to maintain insert for a cooling bed plate transfer grid. The insert supports a wide high capacity roller in a grid pocket modified by removal of a portion of a grid member wherein the modified pocket has more than double the width. High capacity bearings which receive the roller axle are mounted in the frame, which is of modular construction to allow replacement of worn bearings as well as other repair and rebuilding easily. The insert is constructed so that it may be inverted to allow unworn portions of the bearings to experience axle contact whereby the bearing life is increased. In order that inserts may be installed or replaced at a remote location thereby requiring removal of the grid to the remote location, the height of the grid is adjustable.

17 Claims, 3 Drawing Sheets

HIGH CAPACITY AND EASY TO MAINTAIN INSERT FOR COOLING BED PLATE TRANSFER GRID

The present invention relates generally to transfer grids for ferrous and non-ferrous metal plates and the like. More particularly, the present invention relates to inserts clamped thereto and supporting rollers which engage plates being transferred so that friction between the plates and the grid is avoided or reduced. The present invention also relates generally to methods using such transfer grids for cooling such plates.

My prior U.S. Pat. Nos. 5,265,711 and 5,301,785, which are hereby incorporated herein by reference, disclose the clamping of roller supporting inserts in transfer grid pockets for moving of the plates over the rollers. The roller is rotatably mounted by means of a bushing on an axle the ends of which are secured in apertures in plates. Members forward and aft of the roller and sandwiched between and welded to the plates form a frame in which the roller is mounted.

U.S. Pat. No. 5,472,179 suggests a cooling bed plate transfer grid insert which comprises a cast housing which has front and rear end flange portions which seat on successive cross members of the transfer grid and which is clamped by means of J-bolts to these cross members. A roller is mounted in a central slot in the housing. The roller is mounted on the central journal portion of a pin, and the pin further includes rectangular end portions slidably received in vertical slots defined by the housing at opposite sides of the roller. A pair of adjustment screws threadedly engage the end portions of the pin and engage the bottom walls of the side slots so that joint rotation of the screws raises and lowers the roller in a translatory manner. Such an arrangement is not considered to be sufficiently reliable under the rugged conditions encountered in moving hot heavy plates over cooling beds and is considered to be limited in its capacity to handle very heavy plates.

The inserts disclosed in my aforesaid patents have worked well. However, it is considered desirable to be able to provide inserts which can handle heavier plates, are more easily maintained, and have a longer useful life.

It is also considered desirable to install the inserts in a grid at a remote location (insert supplier's business location) where suitably skilled workers are available to allow the cooling bed operator to make the changeover more quickly and inexpensively and without the need on site for people skilled in insert installation.

Accordingly, it is an object of the present invention to provide an insert which has an increased capacity for handling heavy plates, which would allow the number of inserts required to be reduced, and would allow their placement on the leading and trailing ends of the cooling bed where "torpedo rollers" have heretofore normally been placed.

It is a further object of the present invention to provide an insert which has long useful life.

It is another object of the present invention to provide an insert which is easy to repair and rebuild.

It is yet another object of the present invention to provide such an insert which is rugged and reliable.

It is a further object of the present invention to provide for installation of the inserts in a grid at a remote location.

In order to provide an increased capacity insert, in accordance with the present invention, the insert is sized to have a larger roller, and a portion of a transfer grid member is removed to accommodate the increase width insert. Bearings for the roller are mounted in the frame so that the bearing capacity may be increased by a factor of perhaps as much as 2 or more.

The insert is constructed so that it may be inverted (turned over) so that unworn portions of the bearings may be exposed to the axle whereby the life of the bearings may be increased.

The insert also has a modular construction which allows the roller and axle to be removed and the bearings replaced when they are worn out thereby allowing ease of repair and re-building and also allowing the roller and axle to be of single piece construction.

In order to provide for installation or replacement of inserts at a remote location where skilled persons are available, in accordance with the present invention the transfer grid height is adjustable so that it can easily and quickly be re-installed.

The above and other objects, features, and advantages of the present invention will be apparent in the following detailed description of the preferred embodiment thereof when read in conjunction with the accompanying drawings wherein the same reference numerals denote the same or similar parts throughout the several views.

DETAILED DESCRIPTION OF THE PREFERRED EMBODIMENT

Figure 1:
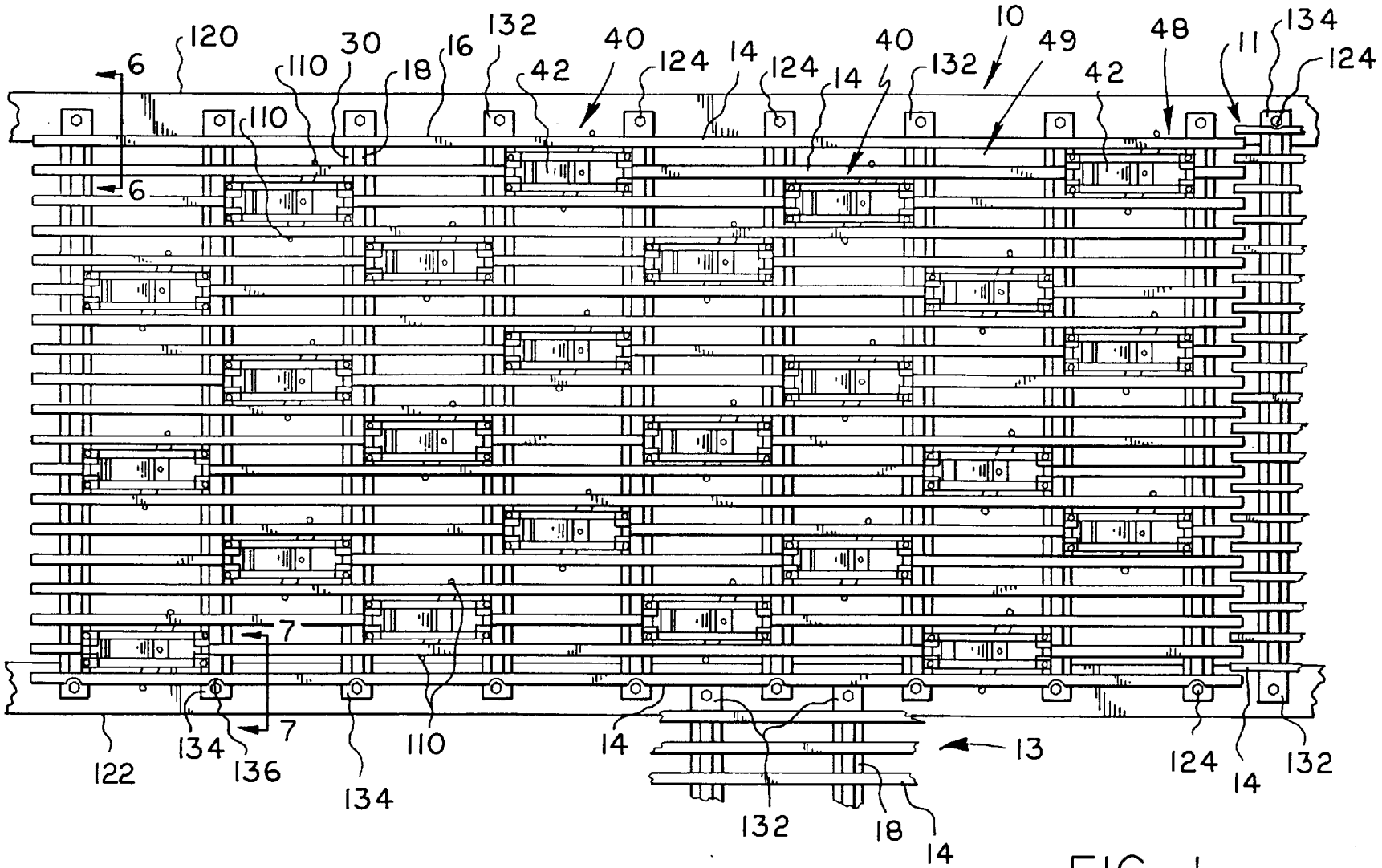
FIG. 1 is a plan view of a plate transfer grid which embodies the present invention installed in a cooling bed and having a plurality of inserts mounted thereto.
Figures 2, 3, 4:
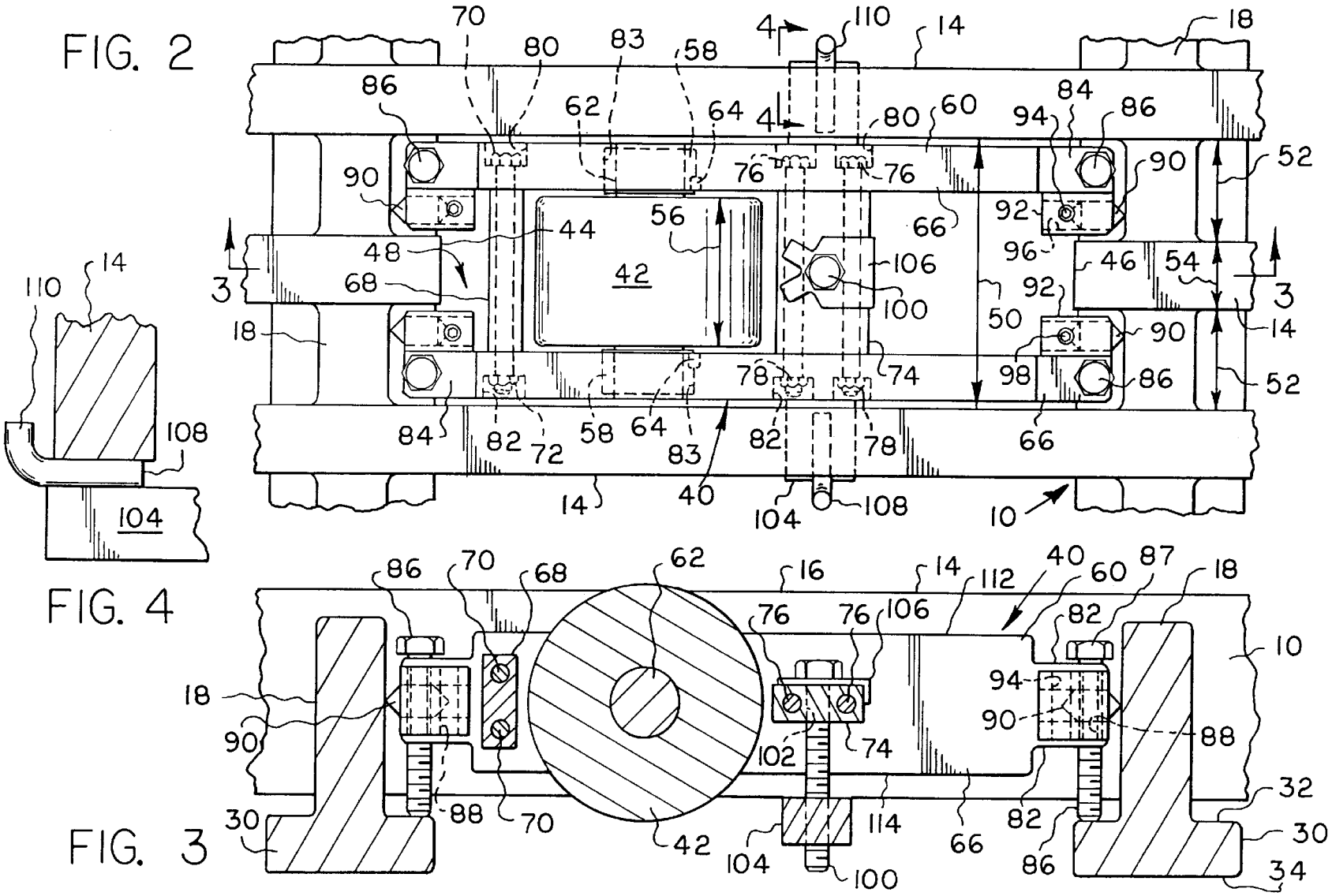
FIG. 2 is an enlarged plan view of one of the inserts mounted to the cooling bed plate transfer grid.
FIG. 3 is a sectional view thereof, with portions of the grid removed for clarity, taken along lines 3—3 of FIG. 2.
FIG. 4 is a detail sectional view taken along lines 4—4 of FIG. 2.

Referring to the drawings, there is illustrated generally at 10 a grid which, with a plurality of like grids, forms a cooling bed for transferring hot ferrous and non-ferrous metal plates and for cooling them by air circulation and the passage of time as they are moved therealong such as by chains or the like. The transfer grid 10 is cast or fabricated as a weldment or otherwise suitably constructed in a single piece of iron or other suitable material and includes a plurality of first parallel portions or members 14 extending in the direction of travel of the plates and providing upper surfaces 16 which, without the inserts described hereinafter, frictionally engage the metal plates for sliding movement of the metal plates therealong. The members 14 are supportedly joined by cross-portions or cross-members 18 which extend at right angles thereto. The members 14 project above the cross-members 18 a distance of perhaps about ½ inch to provide the supporting surfaces 16 receiving the plates and along which the plates are conveyed from left to right, as seen in FIGS. 1, 2, and 3. This distance could be reduced by wear to zero. As seen in FIG. 3, the lower portions of the cross-members 18 are sometimes flanged to provide lower flanges 30 having upper and lower surfaces 32 and 34 respectively. The members 14 and 18 are slightly tapered so as to have a greater thickness at the bottom surfaces thereof. The space bounded by a pair of members 14 and a pair of cross-members 18, which space is generally rectangular, defines a pocket The transfer grid 10 as so far described is of a type which is conventional in the art and is described in greater detail in my aforesaid patents. The transfer grid 10 and other grids, illustrated at 11 and 13, which are side-by-side and in end-to-end relation therewith respectively, are supported by steel beams 120 or other suitable supports, which extend generally under the outer members 14 which are along opposite side edges of the grid, in a manner which will be discussed in greater detail hereinafter.

The frictional sliding movement of the metal plates over the surfaces 16 of the members 14 causes wear thereof with the result that frequent replacement of the entire grid has been typically required at high cost. In addition, the under surface of the plates may undesirably be marred as they are conveyed along the grid members 14. In my aforesaid patents, a plurality of inserts, providing rollers, are disclosed as being mounted in the pockets in order to reduce such wear and marring.

In order to handle heavier/thicker plates as well as to allow a reduction in the number of inserts required, in accordance with the present invention a wider insert, illustrated generally at 40, is provided to support a wider roller 42. The grid 10, for example, has 24 inserts 40 generally evenly dispersed over its area. However, the quantity of inserts installed may vary according to the application or the position of the grid on the cooling bed. In order to accommodate the wider insert 40, a web or portion of a member 14 is removed, as at 44 and 46, over substantially the distance between a pair of adjacent cross-members 18 to provide a modified or relatively wide pocket 48 having a width, illustrated at 50, which is more than twice the width, illustrated at 52, or of the relatively narrow pocket, illustrated at 49, for the grid, i.e., width 50 is equal to twice width 52 (distance between adjacent members 14) plus the width, illustrated at 54, of the member 14. This thus permits the width of the insert 40 to be, for example, perhaps about 5½ inches as compared to a width of perhaps about 2 inches for the inserts disclosed in my aforesaid patents. As a result, the roller 42 may have a much greater width, illustrated at 56, of perhaps about 3.38 inch for the desired greater capacity. Such a larger capacity insert may also be suitable for placement on the leading and trailing ends of the cooling bed where heavy duty 6 inch wide "torpedo" rollers have been heretofore mounted to the frame or apron structure.

In order to provide increased bearing capacity of perhaps 2 to 2½ times the capacity for handling the larger capacity roller 42, in accordance with the present invention the bearings, illustrated at 58, for the roller 42 are mounted in the insert frame, illustrated at 60, as discussed in greater detail hereinafter.

The roller 42 has a shaft or axle 62 which rotatably engages the bearings 58, and a spring pin, illustrated at 64, is provided for each bearing 58 for prevention of bearing rotation. In order that the roller 42 and axle 62 may more durably be of a single piece construction as well as to allow easier repair and rebuilding, in accordance with the present invention the frame 60 is of a modular construction as follows. The frame 60 includes a pair of parallel elongate members or weldments 66 which extend parallel to the grid members 14 when the insert 40 is mounted in the pocket 48. The frame members 66 are detachably attached by suitable means such as (1) a plate 68 which is adjacent the leading end portion of the insert and which extends between and is attached to frame members 66 by a pair of vertically spaced hex head bolts 70 and hex nuts 72 or by other suitable means, and (2) a plate 74 which is intermediate the insert ends (generally centrally thereof) and which extends between and is attached to frame members 66 by a pair of horizontally spaced hex head bolts 76 and hex nuts 78 or by other suitable means. The heads of the bolts 70 and 76 are suitably received within recesses 80 respectively in one of the frame members 66. The nuts 72 and 78 are suitably received within recesses 82 respectively in the other of the frame members 66. The bearings 58, which may be suitable high temperature bearings, are suitably received in bores 83 in the frame members 66 respectively. Thus, the bearings 58 may be easily replaced by removing the bolts 70 and 76 so that the frame members 66 are detached and the axle 62 removed from the bearings 58 for their replacement. As a result, the roller 42 and axle 62 may desirably be of single piece construction.

The end portions 84 of the insert members 66 are vertically stepped inwardly, as illustrated at 82, thereby providing reduced thickness end portions. A hex head screw 86 is threadedly received in a vertical threaded aperture 88 in each of the end portions 84 to extend below the respective end portion 84 and engage the upper surface 32 of the respective flange 30 whereby to effect resting of the insert on the flanges and allow adjustment of the height of the insert by manipulating the screws 86. Hex heads 87 on the screws 86 are provided to eliminate the periodic cleaning which may be needed for allen screws and to allow easier adjustment with standard socket wrenches. The steps 82 are suitably sized so that the hex heads on screws 86 do not undesirably protrude above members 66 and interfere with plates passing over the insert.

Welded or otherwise suitably attached to each of the end portions 84, inwardly thereof, is a member 92 in which is suitably contained in a horizontal bore 96 thereof a plunger pin 90 with cone-shaped ends. Each plunger pin 90 is oriented to protrude from the respective bore for engaging the respectively adjacent cross-member 18 for longitudinally stabilizing the insert 40. If desired, similar plunger pins may be alternatively or additionally provided for laterally stabilizing the insert, as disclosed in my aforesaid patents. Vertical threaded apertures 94 in members 92 extend from the upper surfaces thereof downwardly to the lower surfaces thereof over the entire height thereof, and the plunger pin bores 96 open into apertures 94 respectively. Plunger screws 98 in the form of set-screws are threadedly received in the vertical apertures 94 for engaging the plunger pins 90 respectively for adjusting insert longitudinal stability. The plunger screws 98 have cone points on their lower ends which may taper at an angle of perhaps about 45 degrees to engage the similar points (cone-shaped ends) on the inner ends of the plunger pins 90, at generally the same angle, to force the plunger pins 90 outwardly a suitable distance to achieve the desired stability. The plunger screws may be provided with lock nuts.

A hex head bolt 100 is received in a vertical aperture 102 in cross-member 74 and centrally disposed between the longitudinal frame members 60 to extend below the cross-member 74. An elongate member 104 is threadedly engaged by the lower end portion of the bolt 100 and has a length to extend under both of the longitudinal frame members 60 for clamping the insert 40 to the grid 10. Thus, with the roller height adjusted by means of screws 86, the bolt 100 may be turned to swing the member 104 so that it is oriented cross-wise to the frame members 66 and under both of the grid members 14. The bolt 100 is then manipulated while holding the member 104 in the orientation so as to clampingly tighten the clamping member 104 to the grid members 14. The height adjusting screws 86 and clamping bolt 100 may be alternately manipulated until the roller position is suitably obtained, and the plunger pins 90 are also suitably adjusted by means of screws 98 until the insert is suitably stabilized. A locking tab washer 106 is provided for the clamping bolt 100 and suitably tack-welded or formed/bent to the member 74 to prevent the bolt 100 from working loose over time.

While one embodiment of mounting means for the insert is described herein, it should be understood that the insert may be mounted in various other ways such as, for example, disclosed in my aforesaid patents, and such other suitable mounting means are meant to come within the scope of the present invention.

As seen in FIG. 3, an L-bar 108 is welded or otherwise suitably attached to each end of the clamping member 104 to have a portion 110 which extends upwardly from the clamping member end to engage the side of the respective grid member 14 to prevent the clamping member 104 from rotating and thereby working loose. Alternatively, a plate or other suitable member may be welded or otherwise suitably attached to each end of the clamping member 104, or the clamping member may be formed to have a portion integrally formed therewith at each end thereof to lie above the plane of the remainder of the clamping member for engaging the sides of the grid members 14 respectively for preventing clamping member rotation. As seen in FIG. 1, the clamping members 104, with the L-bar portions 110 at each end, are accordingly skewed to the transverse direction of the grid.

It can be seen that all of the apertures 88, 94, and 102 extend all of the way through their respective members so as to open out at both the bottom and upper sides or surfaces thereof. This permits the respective screws or bolts to be received in the apertures from either end thereof. The steps 82 on the lower surfaces 114 of members 66 allow the hex heads of bolts 86 to be recessed or out of the way if inserted from the lower surfaces 114 as well as the upper surfaces 112 of the members 66. In addition, it can be seen that the roller 42 extends radially outwardly of the lower surfaces 114 as well as upper surfaces 112 of members 66. The insert 40 is thus suitably constructed, in accordance with the present invention, so that it can be used in the position shown in the drawings or in an inverted (upside down or turned over 180 degrees) position wherein the upper surfaces 112 become the lower surfaces and the lower surfaces 114 become the upper surfaces. The mounting of the bearings 58 in the frame 60 causes the bearings to experience contact (i.e., wear) on only one side. In order to achieve longer (i.e., twice) the bearing life, in accordance with the present invention, the wear on the bearings 58 may be monitored, and, when they have worn by a certain amount (perhaps about 90% worn), the insert 40 is desirably inverted (removed from the pocket and re-mounted upside down in the pocket) to thereby expose the unworn portions of the bearings to the contact and in effect have new bearings.

Thus, the insert 40, and its method of installation and use, is provided to have high capacity for handling heavy/thick plates while achieving long bearing life in a modular construction which allows ease of bearing replacement as well as other repair and rebuilding thereof.

Figure 5:
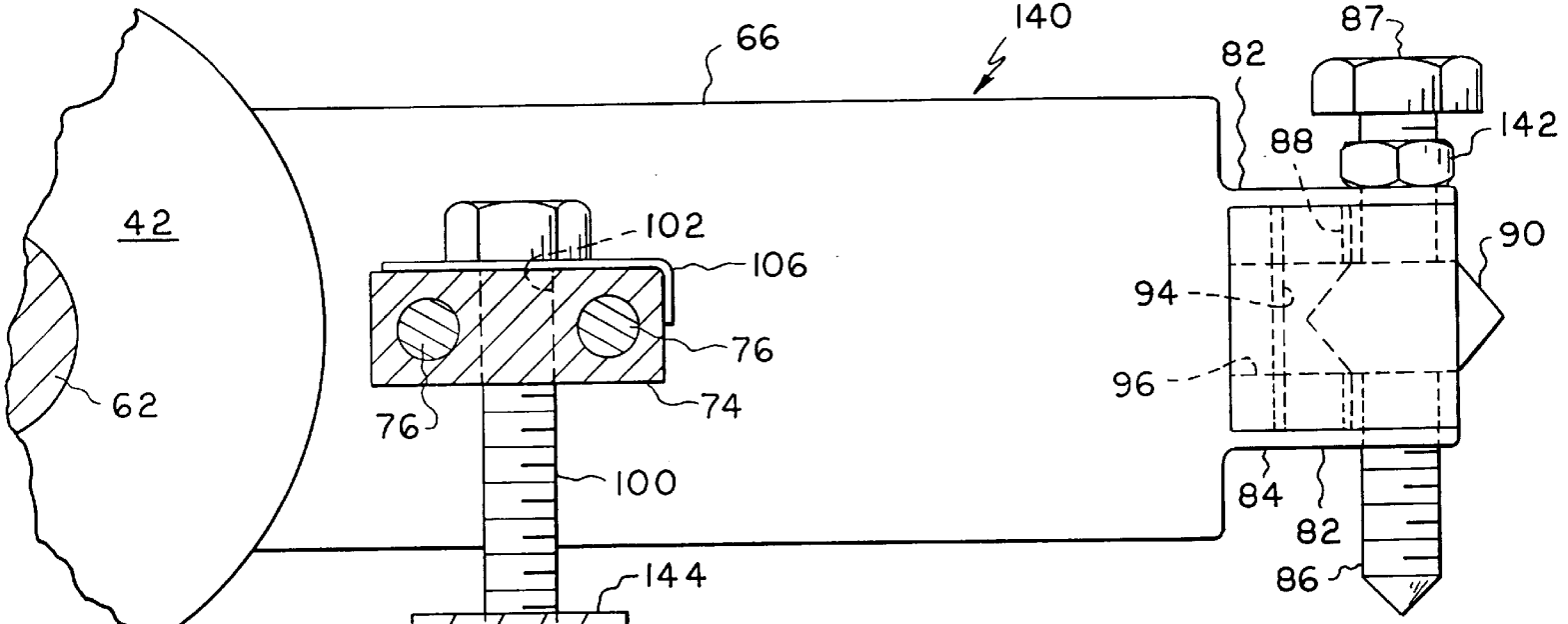
FIG. 5 is a partial view similar to that of FIG. 3 and enlarged illustrating an alternative embodiment of the insert.

Referring to FIG. 5, there is illustrated at 140 an alternative embodiment of the insert which is similar to insert 40, except as described hereinafter. As seen in FIG. 5, a lock nut 142 is provided on each of the screws 86 adjacent the screw head 87 to prevent them from working loose.

In the embodiment of FIG. 5, the lower end of the bolt 100 is received in an unthreaded aperture 152 of elongate clamping member 144 which, like clamping member 104, has a length to extend under the correspondingly adjacent members 14 and may have L-bars 108 or other suitable members attached to or integral therewith for preventing rotation of the clamping member 144. A spring/split lock-washer 146 and a nut 148 are received in a pocket or recess 150 in the lower surface of the clamping member 144. The aperture 152 opens into the recess 150, which is sized to prevent rotation of the nut 148. The lower end of the bolt 100, after passing through the aperture 152 and spring washer 146, threadedly engages the nut 148 so that, by turning the bolt 100, the clamping member 144 may be caused to tightly engage the members 14 for clamping the insert 140 to the grid 10. The spring lock-washer 146 is provided to maintain a tight clamping force with the grid during conditions in which, during use of the grid, portions thereof may receive high concentrations of heat and expand or distort such that the clamping member 144 would otherwise become loose for a period of time, the spring effect of the lock washer 146 for maintaining clamping pressure until the grid stabilizes.

Since the installation or replacement of inserts is a procedure best handled by skilled workers, it is considered desirable that such a procedure be handled not at the site of operation of the cooling bed but at a remote site, i.e., the insert supplier's business, where workers skilled in installing inserts are available. This would allow the cooling bed operator to more quickly and inexpensively complete a changeover, using less skilled workers and with less fatigue to the installers. However, it is necessary that all of the grids be the same height, but the support structure under the grids is not consistent enough to allow all of the grids to be the same height when mounted thereon. The insertion of shims to adjust the grid height has undesirably been a cumbersome process, and, due to the effects of extreme temperature changes, shims may have to from time to time be added or subtracted In order to allow the cooling bed operator to easily and quickly replace a grid 10 after installation or replacement or repair of inserts at a remote site and thereafter easily and quickly re-adjust its height, in accordance with the present invention a plurality of perhaps 9 height adjusting bolts 124 are spaced along each of the opposite sides of the grid 10, as seen in FIGS. 1, 6, and 7.

Bolts 124 may be fully threaded hardened bolts which are threadedly received in drilled and tapped apertures 126 in the grid 10, as described hereinafter. The bottom ends of the bolts 124 terminate in cone points 128 for "digging into" and forming mating cavities in the upper surfaces of the beams 120 and 122 respectively. A hex jam nut 130 is received on the bolt 124 to "lock" the grid at the desired height when the bolts 124 have been suitably manipulated to achieve the desired height. The adjusting bolts 124, in addition to providing ease of adjustment of grid height, also act as insulators, i.e., to isolate the beams 120 and 122 partially from heat which is transferred to the grids by the hot metal plates to thereby reduce the effects of the heat on the beams.

Figure 6:
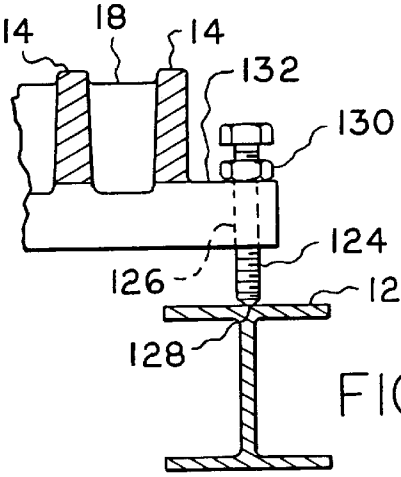
FIG. 6 is an enlarged sectional view of the grid taken along lines 6—6 of FIG. 1.

One side of the grid 10 (under which beam 120 of FIG. 6 is located) has a plurality of second member extension portions or foot pads 132 containing the apertures 126.

Figure 7:
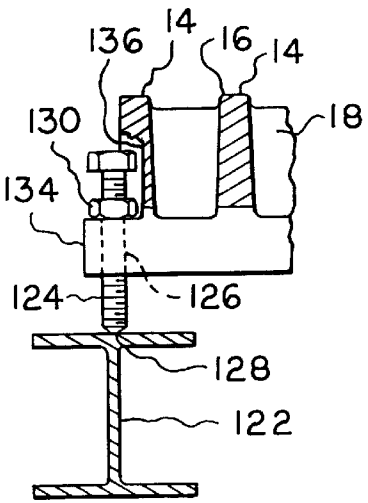
FIG. 7 is an enlarged sectional view of the grid taken along lines 7—7 of FIG. 1.

The other side of the grid 10 (under which beam 122 of FIG. 7 is located) has second member extension portions 134 which extend outwardly a smaller distance than foot pads 132 extend. In order to provide room for the hex heads of bolts 124 and for the nuts 130, generally semi-circular portions are milled from the adjacent member 14 to provide generally semi-cylindrical grooves, illustrated at 136, therein.

End-to-end grids 10 and 11 are shown in FIG. 1 to be placed with members 14 in grid 10 offset from members 14 in grid 11. As a result, the side of grid 11 under which beam 120 partially lies is provided with the extension portions 134, while the other side is provided with the foot pads 132 of FIG. 6. Side-by-side grids 10 and 13 are shown to be placed with members 18 in grid 10 offset from members 1-8 in grid 13, and with foot pads 132 of grid 13 in an alternating relationship with the extension portions 134 of grid 10. However, it should be understood that the grids can be laid in other ways such as in abutting relationships. Alternatively, a grid may have foot pads 132 along both sides or extension portions 134 along both sides. The adjusting bolts may alternatively be provided along both of the sides which constitute ends, i.e., which extend in a direction parallel to the second members 18.

While the relatively wide pockets 48 are needed for the wider inserts 40, if the first members 14 were spaced so that all of the pockets were relatively wide pockets 48, then it would be difficult for workers to walk on the grids. In order to provide ease of movement of workers over the grids, they are thus, in accordance with the present invention, constructed or adapted, as previously discussed, to provide a suitable number of relative wide pockets 48 for receiving inserts 40 or 140 and with the remaining grid space having relative narrow pockets 49.

It should be understood that, while the present invention has been described in detail herein, the invention can be embodied otherwise without departing from the principles thereof, and such other embodiments are meant to come within the scope of the present invention as defined by the appended claims.

What is claimed is:

1. An insert for a cooling bed plate transfer grid having a plurality of elongate parallel first members and a plurality of elongate second members extending crosswise to the first members, the insert comprising a body, bearing means in said body, roller means having an axle which is mounted in said bearing means to project above said body, and means for clamping said body to the transfer grid so that said roller means protects above the transfer grid, wherein said body is adapted to be inverted whereby to expose an unworn portion of the bearing means to axle contact.

2. An insert according to claim 1 further comprising means for removably mounting said axle in said bearing means.

3. An insert according to claim 1 wherein said body comprises a pair of elongate generally parallel members, said bearing means comprises a bearing in each of said elongate body members for rotatably receiving said axle, and the body further comprises means for removably mounting said axle in said bearing means, said removably mounting means comprises means for detachably attaching said elongate body members together with said axle rotatably received in said bearings.

4. An insert according to claim 1 wherein said clamping means comprises adjusting screws in said body and extendible downwardly therefrom to engage flange portions of the transfer grid for adjusting the height of said body, at least one clamping member having a length and disposed so that end portions thereof underlie a respective pair of members of the transfer grid, and means for drawing said clamping member tightly against the respective pair of members of the transfer grid.

5. An insert for a cooling bed plate transfer grid having a plurality of elongate parallel first members and a plurality of elongate second members extending crosswise to the first members, the insert comprising a body, bearing means in said body, roller means having an axle which is mounted in said bearing means to project above said body, and means for clamping said body to the transfer grid so that said roller means projects above the transfer grid, wherein said clamping means comprises adjusting screws in said body and extendible downwardly therefrom to engage flange portions of the transfer grid for adjusting the height of said body, at least one clamping member having a length and disposed so that end portions thereof underlie a respective pair of members of the transfer grid, and means for drawing said clamping member tightly against the respective pair of members of the transfer grid, wherein said drawing means comprises aperture means in said clamping member, a recess means in a lower surface of said clamping member, a spring washer and nut in said recess means, said recess means sized to prevent rotation of said nut, and a bolt extending from said body and received in said aperture means, said recess means, and said washer and threadedly engaged to said nut.

6. An insert according to claim 1 wherein the first and second transfer grid members define a plurality of pockets having a width equal to the distance between adjacent first members, the insert characterized by said body being sized to be received in an enlarged pocket formed by removal of a portion of a first member whereby two adjacent pockets form the enlarged pocket and whereby the roller means width is increasable to provide increased capacity.

7. An insert according to claim 6 wherein said body has a width which is greater than said width of the plurality of pockets and less than a width of the enlarged pocket.

8. A method for cooling hot metal plates formed in a plate mill comprising the steps of:

a. Providing a cooling bed plate transfer grid having a plurality of elongate parallel first members and a plurality of elongate second members extending crosswise to the first members for support thereof and defining therewith a plurality of pockets of a first size and at least one pocket of a second size of increased width;

b. clamping to the transfer grid an insert having a body and at least one roller sized for said increased width pocket so that the insert is supported in said increased width pocket with the roller projecting above the insert body and the first and second members for rotatable engaging the metal plates as they are moved along the transfer grid;

c. positioning the metal plates on the transfer grid;

d. moving the plates along the transfer grid with the roller engaging the plates; and e. selecting the insert to have bearings in which are receivable an axle for the roller and inverting the insert when either of the bearings has a worn portion to expose unworn portions of the bearings to axle contact.

9. A method according to claim 8 further comprising selecting the insert to have the axle for the roller removably receivable in the bearings and replacing either of the bearings when worn.

10. A method according to claim 8 comprising removing a section of one of the first members between a pair of the second members to provide said increased width pocket.

11. A method for maintaining an insert clamped in a pocket of a cooling bed plate transfer grid comprising selecting the insert to have at least one roller including an axle and a pair of bearings in which the axle is received, and inverting the insert when a portion of at least one of the bearings has become worn to thereby expose unworn portions of the bearings to axle contact.

12. A method according to claim 11 further comprising removing the roller and axle and replacing at least one of the bearings when either of the bearings is worn out.

13. A method for maintaining an insert clamped in a pocket of a cooling bed plate transfer grid comprising selecting the insert to have a pair of elongate generally parallel members which are detachably attached, at least one roller including an axle, a bearing in each of said elongate members for receiving the axle, the axle being removable when the elongate members are detached, inverting the insert when either of the bearings has a worn portion to expose unworn portions of the bearings to axle contact, the method further comprising detaching the elongate members, removing the axle and replacing at least one of the bearings when either of the bearings is worn out, replacing the axle, and attaching the elongate members.

14. A cooling bed plate transfer grid comprising means including a plurality of elongate parallel first members and a plurality of elongate second members extending crosswise to said first members for receiving hot metal plates newly formed in a plate mill for passage of the plates for cooling thereof, at least one insert having a body, bearing means in said body, and a roller for engaging the plates and having an axle which is mounted in the bearing means, said body being adapted to be inverted whereby to expose an unworn portion of the bearing means to axle contact, means for clamping said insert to said receiving means so that said roller projects above said receiving means, means for adjusting height of said roller relative to said receiving means, and means connected to the receiving means for adjusting height of said receiving means.

15. A plate transfer grid according to claim 14 wherein said height adjusting means comprises a plurality of adjusting screws spaced along each of a pair of opposite sides of the grid for engaging grid support members.

16. A cooling bed plate transfer grid comprising means including a plurality of elongate parallel first support means and a plurality of elongate second support means extending crosswise to said first support means for receiving and supporting hot metal plates newly formed in a plate mill for passage of the plates for cooling thereof and defining with said first support means a plurality of relatively narrow pockets having a first width, at least one of said first support means being discontinuous over a distance between at least two of said second support means thereby defining at least one relatively wide pocket having a second width, and an insert having a roller for engaging the plates and having a body removably receivable in the relatively wide pocket, said body having a width which is greater than said first width and which is less than said second width, bearing means in said body, said roller having an axle which is mounted in said bearing means, said body being adapted to be inverted whereby to expose an unworn portion of the bearing means to axle contact.

17. A cooling bed plate transfer grid according to claim 16 further comprising means connected to the grid for adjusting height of the grid.

* * * * *